United States Patent [19]

St. Denis

[11] 4,109,421

[45] Aug. 29, 1978

[54] METHOD FOR GRINDING THREAD CUTTING TOOLS

[76] Inventor: Joseph F. St. Denis, 26545 Oakland, Roseville, Mich. 48066

[21] Appl. No.: 776,502

[22] Filed: Mar. 11, 1977

[51] Int. Cl.[2] ..... B24B 1/00; B24B 3/00

[52] U.S. Cl. ..... 51/288; 51/220

[58] Field of Search ..... 51/288, 220, 221, 225, 51/218 R

[56] References Cited

U.S. PATENT DOCUMENTS

| | | | |
|---|---|---|---|
| 1,039,075 | 9/1972 | Smith | 51/225 X |
| 1,875,163 | 8/1932 | Scharff | 51/225 X |
| 2,735,245 | 2/1956 | Grieco | 51/220 |

*Primary Examiner*—Harold D. Whitehead

*Attorney, Agent, or Firm*—Harness, Dickey & Pierce

[57] ABSTRACT

A method and jig for forming both the cutting angle and the relief area on a thread cutting or other form cutting tool having a compound relief angle, which eliminates the need for machining compound angles on the jig and does not require rotary motion of the tool to be cut. The method comprises the steps of providing a horizontal plane jig supporting surface and jig having a plane tool supporting surface in angular relation to said jig supporting surface, the intersection of the planes containing said jig and tool supporting surfaces being perpendicular to a vertical plane containing the cutting edge of said tool, positioning a grinding wheel axis in said vertical plane, retracting the grinding wheel axis perpendicularly from said plane a distance proportional to the desired relief angle, plunging the grinding wheel below the cutting edge, and feeding the grinding wheel axially to grind both the cutting and compound relief angles simultaneously on the tool.

2 Claims, 4 Drawing Figures

METHOD FOR GRINDING THREAD CUTTING TOOLS

BACKGROUND OF THE INVENTION

1. Field of the Invention

The invention relates to the grinding or regrinding of tools used for thread cutting or similar forming tools, in which it is desired to form both a thread cutting angle and a compound relief angle on the tool.

2. Description of the Prior Art

In the past, it has been necessary to either grind the cutting edge and the relief or rake angle as successive operations, or provide complicated tools, jigs, or fixtures for grinding both the cutting and relief angles simultaneously. One known construction involves a double angle or compound vise which is shifted in one plane and then in another plane to get the double angle required for the tool with respect to the grinding wheel. A problem with this old construction is that the second shifting operation alters the first angle and therefore the settings must be repeated until they are accurate. It is often necessary to check the tool position with a comparator such as one which compares the tool position with a greatly enlarged drawing. This is a very time consuming operation but is necessary since thread cutting tools must be extremely accurately machined.

Other known constructions and methods include jigs or fixtures having compound angles formed on them and other devices which combine angular surfaces with rotatable bushings in which the tool is mounted. These prior devices have been found unsatisfactory for a number of reasons including their complex nature and cost of manufacture. There is in existence a double angle vise which, when the tool is moved in one plane, automatically compensates for the angle in the other plane, but this is also a very expensive construction.

Among the patents representative of these prior constructions are the following:

| Inventor | U.S. Pat. No. |
|---|---|
| Wilson | 2,385,902 |
| Benjamin et al | 3,065,580 |
| Sherman | 2,912,801 |
| Landy | 2,317,996 |
| Jorgensen | 1,908,155 |
| Heineman | 2,730,846 |
| Grieco | 2,448,309 |

In Wilson U.S. Pat. No. 2,385,902, for example, each pair of surfaces A and B on the fixture are related to each other by a compound angle and it would be very difficult and expensive to manufacture a fixture of this type.

It is known in the field of miller cutter grinding to position a grinding wheel axis in the plane of a cutting edge, retract the grinding wheel from the cutting edge a distance proportional to the relief angle desired, plunge ghe grinding wheel towards the miller cutter and grind the cutter edge. However, the problem of compound angles does not exist in the field of grinding miller cutters and the present invention adapts and varies this known method and combines it with a novel jig construction to achieve the improved results described in this application.

BRIEF SUMMARY OF THE INVENTION

It is an object of the present invention to obviate some of problems inherent in these prior designs and methods for grinding thread cutting and similar forming tools which have compound angles, and to furnish a method and construction which enables the quick, simple and accurate grinding of such tools.

It is a further object to provide a novel and improved method of this character which utilizes, in changed form, a known method for grinding milling cutters by combining this altered method with a novel jig construction so as to achieve the improved results discussed above.

Briefly, the method of this invention is for forming both the cutting angle and the relief area on a thread cutting or other form cutting tool having a compound relief angle. The method comprises the steps of providing a horizontal plane jig supporting surface and jig having a plane tool supporting surface in angular relation to said jig supporting surface, the intersection of the planes containing said jig and tool supporting surfaces being perpendicular to a vertical plane containing the cutting edge of said tool, positioning a grinding wheel axis in said vertical plane, retracting the grinding wheel axis perpendicularly from said plane a distance proportional to the desired relief angle, plunging the grinding wheel below the cutting edge, and feeding the grinding wheel axially to grind both the cutting and compound relief angles simultaneously on the tool.

The method of the present invention is for a thread cutting tool or the like having a compound relief angle, and comprises using a member having a plane bottom surface supportable on a horizontal support, and a plane tool supporting surface supporting said tool and bearing a fixed angular relationship to said bottom surface whereby the intersection of said surfaces will be perpendicular to a vertical plane containing the tool cutting edge.

DESCRIPTION OF THE PREFERRED EMBODIMENTS

Figure 1:
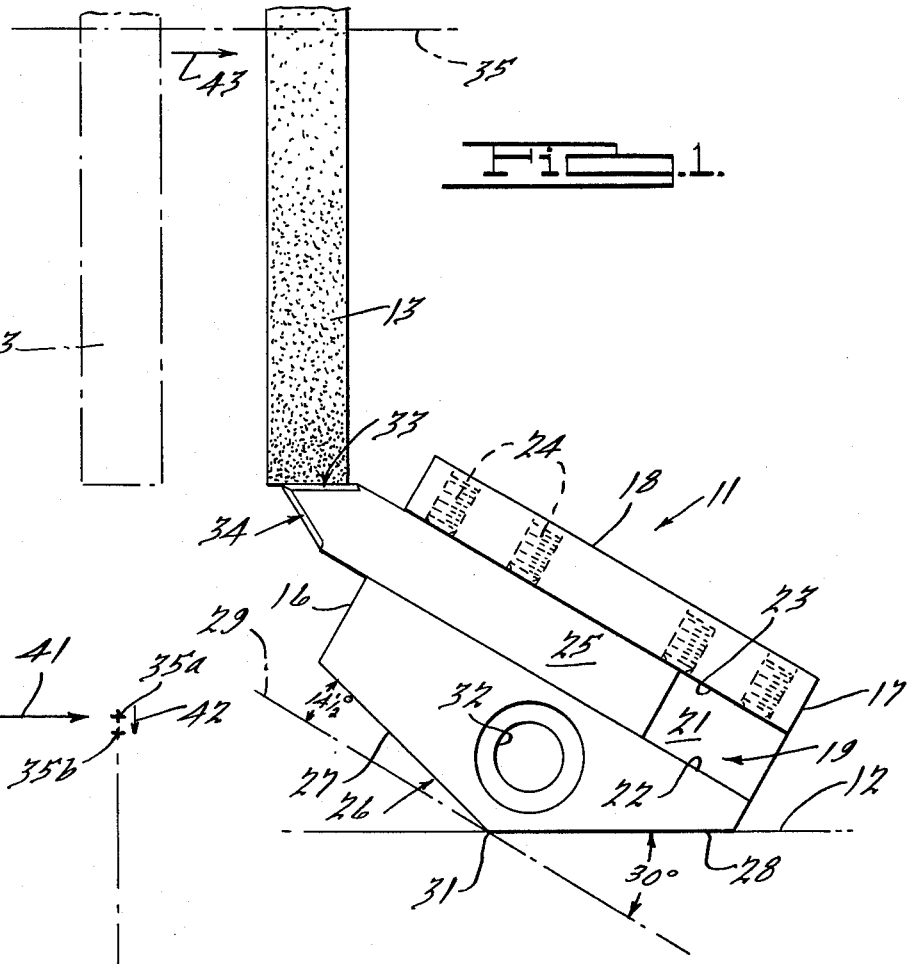
FIG. 1 is a side elevational view of a first embodiment of the invention which is usable to grind thread cutting tools for Acme thread (29°) or V threads (60°)
Figure 2:
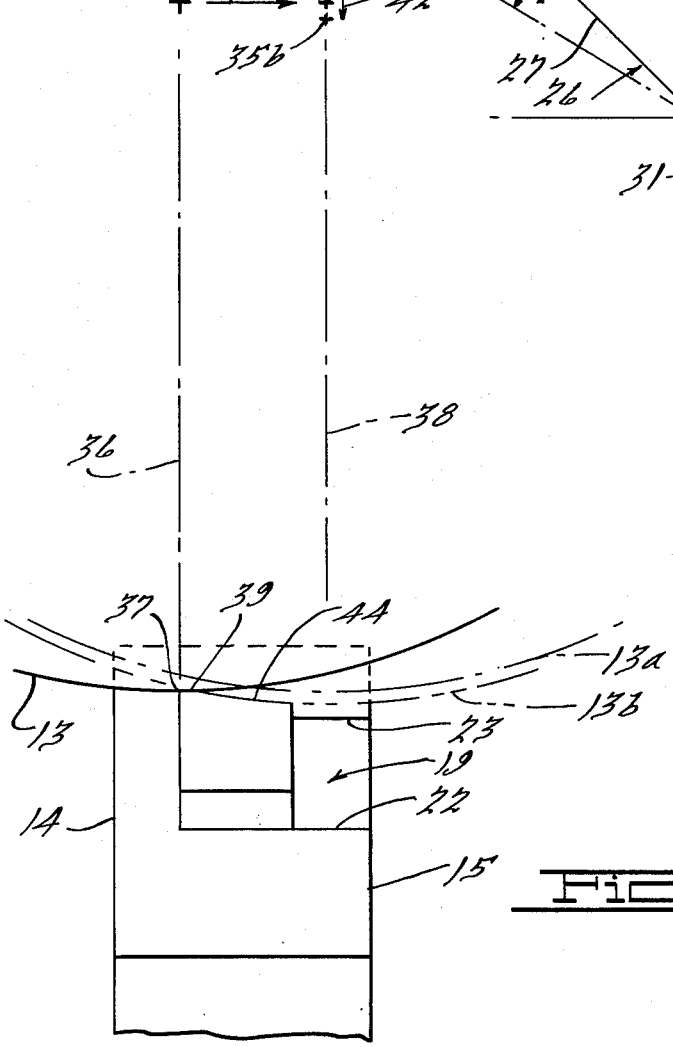
FIG. 2 is a front elevational view taken in the direction of the arrow 2 of FIG. 1 and showing the manner in which the grinding method of this invention is carried out.

The jig of FIGS. 1 and 2 is generally indicated in 11 and is adapted to rest on a table 12 of a grinding machine having a grinding wheel 13. The manner of securing jig 11 to the grinding wheel table may vary according to requirements. The jig has a pair of parallel side surfaces 14 and 15, a pair of end surfaces 16 and 17 perpendicular to the side surfaces, and one end surface 18 perpendicular to both the side and end surfaces.

A tool holding recess generally indicated at 19 is provided in jig 11. This may be in the form of an open sided slot having a side surface 21 parallel to side surfaces 14 and 15, and opposite tool supporting surfaces 22 and 23 parallel to surface 18. Recess 19 is shown as extending between end surfaces 16 and 17 of the jig. A plurality of set screws 24 are provided, accessible from surface 18, for holding a tool 25 in position within recess 19. Tool 25 is a thread cutting or other forming tool of the type requiring a compound relief angle, and is shown as an elongated tool of rectangular cross-sectional shape having four plane side surfaces.

The side of jig 11 opposite surface 18 is generally indicated at 26 and is shown as having two surfaces perpendicular to side surfaces 14 and 15, a surface 27 for grinding Acme thread cutting tools (29°) and a surface 28 for grinding V type thread cutting tools (60°). Surface 27 is inclined 14½° from an imaginary line 29 parallel to surface 18 whereas surface 28 is inclined 30° from line 29, but in the opposite direction from surface 27 so that there is a juncture 31 of the two surfaces intermediate ends 16 and 17. An aperture 32 is provided adjacent juncture 31 which passes between surfaces 14 and 15 of the jig; this aperture is used in the second embodiment of the invention described with respect to FIGS. 3 and 4.

It will be noted from the above that jig surfaces 22 and 23 which support the tool are angularly related to surfaces 27 and 28 such that the imaginary intersections of planes containing surfaces 22 and 23 with planes containing surfaces 27 and 28 form lines perpendicular to a vertical plane 36 (FIG. 2) containing tool cutting edge 37. Thus, no compound angles need be machined on jig 11.

In use of the jig as so far described, if it is desired to grind a tool 25 for a V thread, the tool will be mounted in recess 19 as shown in FIGS. 1 and 2, its tip extending beyond surface 16, and surface 28 of the jig secured to table 12. After the grinding of one side (generally indicated at 33) of the tool has been accomplished, in a manner described below, set screws 24 will be loosened and tool 25 removed, inverted 180° by rotation on its axis, replaced and secured in recess 19 so as to present the side generally indicated at 34 to the grinding wheel. The grinding process will be repeated in the same manner with the result that the two cutting edges of sides 33 and 34 will be separated by an angle of 60° and will have the proper relief angles.

If it is desired to grind a thread cutting tool for an Acme thread (29°), surface 27 will be used instead of surface 28 and the procedure will be as before. After securing surface 27 to table 12 with a tool 25 secured in recess 19 and extending past surface 17, one surface of the tool will be ground. The tool will then be inverted in recess 19 and the other surface ground to create an included angle between the two surfaces of 29°.

The invention relates to the creation of a compound relief or rake angle on both surfaces 33 and 34 of the tool simultaneously with the creation of the cutting edge, without the need for the prior and expensive forming of surfaces with compound angular relationships on the jig, or the need for the other complicated equipment described previously.

Referring to FIG. 2 in which the angular relationship and the sizes of certain surfaces is exaggerated for purposes of clarity, the axis 35 of grinding wheel 13 is first positioned in vertical plane 36 containing the desired cutting edge 37 of tool surface 33. At this time the grinding wheel is withdrawn from the tool as shown in dot-dash lines in FIG. 1. As the next step, grinding wheel 13 is retracted from plane 36 to a position such that its axis is in a plane 38 parallel to but spaced from plane 36. The distance through which the grinding wheel axis moves from the position shown at 35 to that indicated at **35*a* in FIG. 2, will be proportional to the relief or rake angle required for the tool, plus any desired hairline surface 39 which is desired adjacent cutting edge 37. For example, if a relief angle of 10° is desired and a hairline surface of 0.005 inch is also desired adjacent edge 37, the grinding wheel will be moved in the direction of arrow 41 a distance approximately equal to ½ the diameter of the grinding wheel times the sine of 10°, plus 0.005 inch. This will move the grinding wheel surface from the solid line position indicated at 13 in FIG. 2 to the single dot-dash line position indicated at 13*a***.

The next step is to move the grinding wheel, while still away from the tool as shown in dot-dash lines in FIG. 1 in the direction of the arrow 42 of FIG. 2. This plunging movement could be approximately 0.005 inch past the position where the grinding wheel would begin to cut the tool were it positioned over the tool. The grinding wheel axis would then arrive at the position indicated at **35*b* in FIG. 2, and the grinding wheel surface at the position indicated in double dot-dash lines at 13*b*. The grinding wheel may then be fed toward the tool in the direction of the arrow 43 of FIG. 1 so that the leading edge of the grinding wheel will cut the tool surface 33 to create not only cutting edge 37 but relief area 44** at the desired compound relief angle.

After this has been accomplished, and tool 25 inverted in its recess 19, the same series of steps will be carried out with respect to tool surface 34. It will thus be seen that both the cutting edge and compound relief angle may be accurately ground by the above method with the use of a jig which is much simpler to construct that those previously needed.

Figure 3:
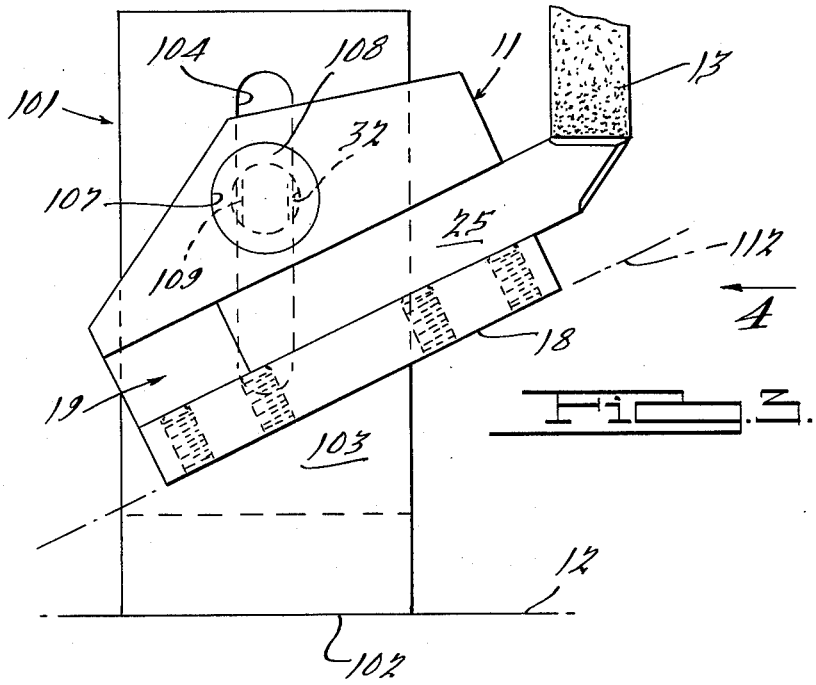
FIG. 3 is a side elevational view of another embodiment of the invention which utilizes the embodiment of FIGS. 1 and 2 but permits its use to grind thread cutting tools to any required angle.
Figure 4:
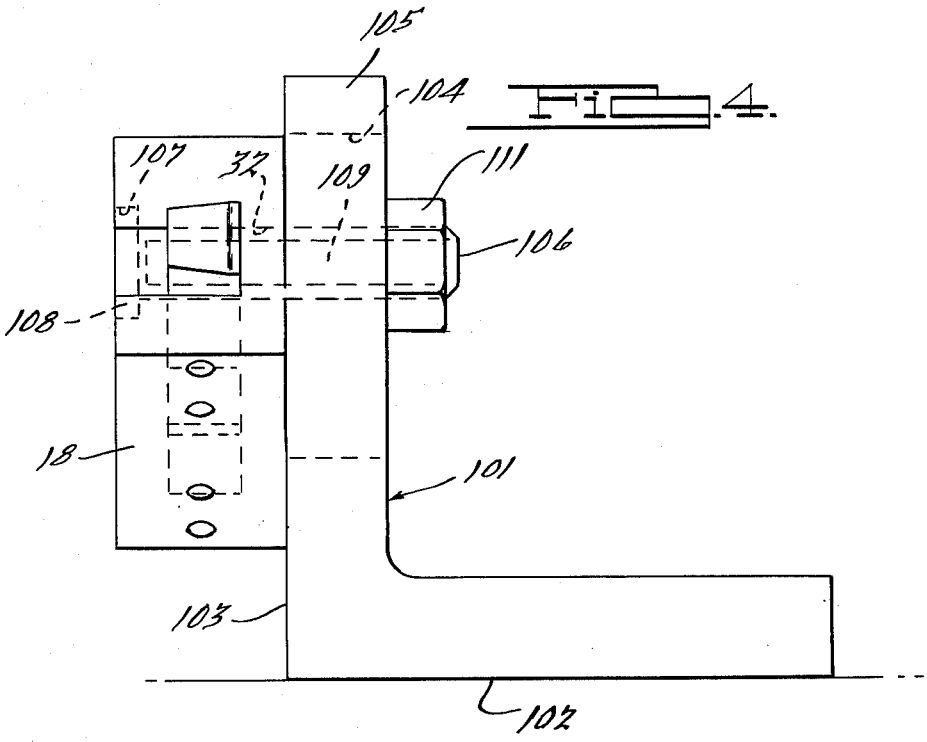
FIG. 4 is a front elevational view of the embodiment of FIG. 3 taken in the direction of the arrow 4 thereof.

FIGS. 3 and 4 show a modified form of the invention which utilizes the first embodiment but permits it to be used in a manner creating any desired angle on a thread cutting tool. Jig 11 is mounted on an angle plate generally indicated at 101. This angle plate has a support surface 102 for securing to table 12, and a vertical surface 103 at right angles to surface 102. A vertical slot 104 is formed in the upright portion 105 of angle plate 101. A securing bolt 106 extends through aperture 32 of jig 11, this aperture being counterbored at 107 to receive the head 108 of the bolt. Slot 104 is narrower than the bolt, which has flattened sides 109 and passes through the slot, being secured by a nut 111.

In operation of the embodiment of FIGS. 3 and 4, jig 11 will be mounted on angle plate 101 in such a manner that its surface 18, which may be termed a setting surface, faces downwardly. Thus, a sine bar or protractor indicated partially in dot-dash lines at 112 may be positioned between surface 18 and table 12 to obtain any desired angle for the jig with respect to grinding wheel 13. As soon as this angle is obtained, nut 111 will be tightened and the jig may be used as before.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

I claim:

1. In a method for forming both the cutting angle and the relief area on a thread cutting or other form cutting tool having a compound relief angle, the steps of providing a jig supporting surface in a horizontal plane and a jig having a tool supporting surface in a plane having an angular relation to said jig supporting surface plane, the intersection of the planes containing said jig and tool supporting surfaces being perpendicular to a vertical plane containing the cutting edge of said tool, placing said tool in said jig so as to be supported by said tool supporting surface, positioning a grinding wheel axis in said vertical plane, retracting the grinding wheel axis perpendicularly from said plane a distance proportional to the desired relief angle, plunging the grinding wheel below the cutting edge, and feeding the grinding wheel axially to grind both the cutting and compound relief angles simultaneously on the tool.

2. A method according to claim 1, said tool being an elongated thread cutting tool, said method comprising the further steps of removing said tool from its supporting surface, inverting the tool by rotating it 180° on its axis, replacing the tool on its supporting surface so that its opposite side faces said grinding wheel, repositioning said grinding wheel axis in said vertical plane containing the tool cutting edge, retracting the grinding wheel axis from said plane a distance proportional to the desired relief angle, plunging the grinding wheel below the cutting edge, and feeding the grinding wheel axially to grind both the cutting and compound relief angles on said opposite side of the tool.

* * * * *

UNITED STATES PATENT AND TRADEMARK OFFICE

CERTIFICATE OF CORRECTION

PATENT NO. : 4,109,421

DATED : August 29, 1978

INVENTOR(S) : Joseph F. St. Denis

It is certified that error appears in the above-identified patent and that said Letters Patent are hereby corrected as shown below:

Column 1, references cited, "9/1972 Smith" should be --9/1912 Smith--;

Column 2, line 55, "in" should be --at--.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*